United States Patent [19]

Faist

[11] Patent Number: 5,022,103

[45] Date of Patent: Jun. 11, 1991

[54] SHOWER ARM EXTENSION

[75] Inventor: Kenneth B. Faist, Tallahassee, Fla.

[73] Assignee: Thomas E. Quick, Tallahassee, Fla.

[21] Appl. No.: 357,207

[22] Filed: May 26, 1989

[51] Int. Cl.[5] ..... A47K 3/22

[52] U.S. Cl. ..... 4/596; 4/567; 4/570; 4/605; 4/615

[58] Field of Search ..... 4/596, 605, 559, 567–570, 4/615, 620, 597, 599, 606, 612, 661; 239/211, 446

[56] References Cited

U.S. PATENT DOCUMENTS

| | | | |
|---|---|---|---|
| 167,817 | 9/1875 | Bailey | 4/570 |
| 2,862,211 | 12/1958 | Shabarman et al. | 4/615 |
| 2,966,311 | 12/1960 | Davis | 4/596 |
| 4,282,612 | 8/1981 | King | 4/605 |
| 4,413,362 | 11/1983 | Chianco et al. | 4/567 |
| 4,901,927 | 2/1990 | Valdivia | 4/601 X |

FOREIGN PATENT DOCUMENTS

| | | | |
|---|---|---|---|
| 602213 | 9/1934 | Fed. Rep. of Germany | 4/615 |

*Primary Examiner*—Henry K. Artis
*Attorney, Agent, or Firm*—Arthur G. Yeager

[57] ABSTRACT

An extension pipe for raising the elevation of a shower head comprising an S-shaped length of pipe having external threads on each end thereof, the lower end being a straight horizontal section of pipe and the upper end being directed downwardly from about 15° to about 45° below horizontal.

4 Claims, 1 Drawing Sheet

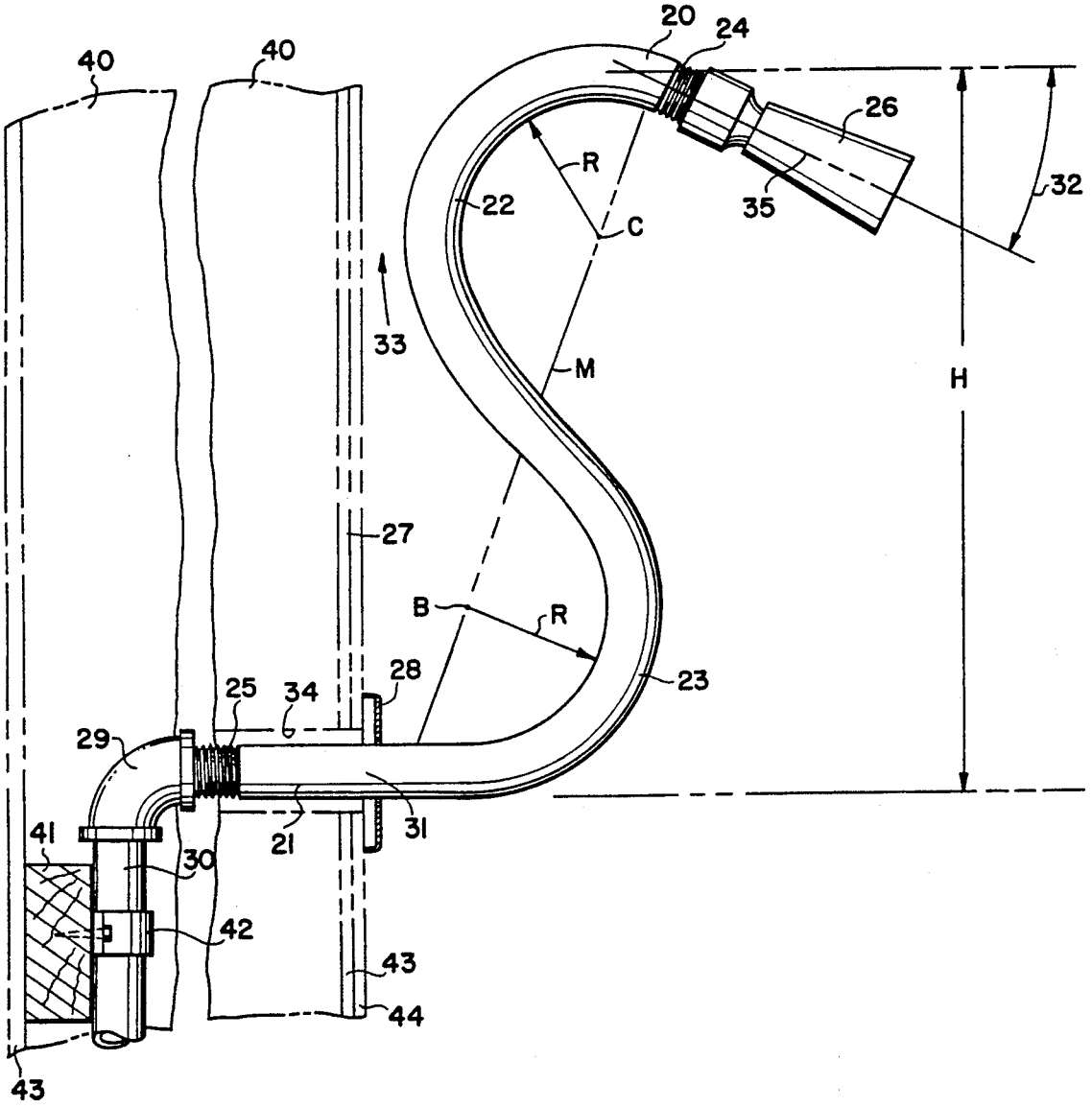
20
24
40
40
26
R
32
22
C
35
33
M
H
27
B
R
23
28
25
34
29
31
21
41
30
42
43
44
43

SHOWER ARM EXTENSION

BACKGROUND OF THE INVENTION

Bath tubs and some shower stalls frequently have shower heads that are too low for convenient use by tall persons. There generally is no inexpensive way to change a low shower head into a high shower head. There are available in the market place flexible hose or pipe that can be connected to a faucet or to a pipe joint and a hanger device from which the shower head may be suspended. These solutions are not acceptable to those who want a permanent rigid connection for a shower head that may be pointed in any direction desired.

It is an object of this invention to provide a novel shower arm extension. It is another object of this invention to provide a shower arm extension that is S-shaped and a rigid inflexible fixture. Still other objects will become apparent from the more detailed description which follows.

BRIEF SUMMARY OF THE INVENTION

This invention relates to a shower arm extension comprising an S-shaped length of rigid water pipe having an upper end and a lower end, each of which having external pipe threads thereon, said lower end being substantially straight and horizontal for about one-half of the total horizontal distance between said ends and said upper end being directed downwardly from about 15° to about 45° below horizontal.

In a preferred embodiment of this invention the straight portion on the lower end of this extension is sufficiently long to extend through a wall to a pipe connection and be turned to engage the pipe threads on that lower end without interference by the wall or ceiling.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawing showing an exploded side elevation of the shower arm extension of this invention.

DETAILED DESCRIPTION OF THE INVENTION

The invention is best understood by reference to the attached drawing showing an exploded view of the shower arm extension as it appears in a side elevation.

The shower arm extension 10 is a length of rigid pipe, preferably brass pipe which is chrome plated or having a highly polished or antique, or a colored finish. The extension 10 is formed into a general S-shape with an upper end 20, a lower end 21, an upper bend 22, a lower bend 23, and with external threads 24 on upper end 20 and external threads 25 on lower end 21. The extension is designed to be connected through a wall 27 to an inlet water pipe 30 and a pipe elbow 29 or other pipe connection which presents a horizontal outlet, e.g., a pipe tee or the like. Normally in a house construction having walls formed with, for example, 2"×4" cross piece 41 is nailed between adjacent studs 40 and a pipe strap 42 is nailed thereto about pipe 30 to accurately position the elbow 29 at the predetermined height according to standard installation guidelines, at 6'2" above the inside of the floor before providing the sheet rock 43 and/or tile 44 on the studs 40 forming the wall 27 through which the elbow 29 is exposed.

The lower end 21 includes a straight section 31 of pipe which is sufficiently long to permit threaded portion 25 to be connected to elbow 29 by turning the extension so as to engage the threads without causing upper bend to touch wall 27 or the top wall, (not shown). In other words, there must be some space 33 to permit connecting lower end 21 to elbow 29 without the interference of wall 27 or the top wall above extension 10. Generally, the length of straight section 31, before bend 22 would contact wall 27, is at least 2" for use with a 2"×4" stud wall 27 and about 3" for a 2"×6" stud wall 27, unless the cross-piece 41 were positioned for a 2"×6" stud wall as is it were a 2"×4" stud wall.

Upper end 20 is connected to any selected shower head 26 by engagement with threaded portion 24. In order that shower head 26, normally having a swivel connection therein, is pointed in the proper direction upper end 20 should have its central axis 35 directed downwardly from the horizontal from about 15° to about 45° (as shown at 32) preferably about 20° to about 30°. The S-shaped midportion 11 is comprised of bends 22 and 23 and each of these bends has a radius R of about 2" for an extension height H of about 10". It is thus preferable to have the axis 35 generally perpendicular to a line M which passes through the spaced centers C and B of the bends 22 and 23 to provide a pleasant curvature and to dispose the upper bend 22 in an appropriate position with respect to the wall 27.

Lower end 21 of extension 10 normally must reach through a wall 27 to connect to a water pipe 30 hidden behind the wall 27 for aesthetic purposes. Therefore, there generally is a passageway 34 cut through wall 27 which must be covered by an escutcheon plate 28 to provide a neat appearance in the shower area and to inhibit water from entering through passageway 34.

It is recognized that this shower arm extension may be bent into several different shapes to accomplish the intended purpose of extending the shower head upwards to a suitable elevation for use by tall persons. The shower arm extension might be fabricated more angular by using substantially straight sections of pipe joined to each other by elbows or the like, although such fabrication would normally be unsightly and is not preferred. It is intended, however, to provide in this invention an aesthetically attractive extension made in one piece with such extension being in substantially the same vertical plane. Bends 22 and 23 may be more or less pronounced, that is, change the pipe direction to a greater or lesser angle and still be within the spirit of this invention. The radius of each bend is between about 1½ to about 2½ inches, which is somewhat dependent on, inter alia, the height of the extension, as measured vertically between ends 20 and 21, from about 6 to 14 inches. Regardless of the precise shape, however, there must be a straight section 31 in lower end 21 and a generally downwardly directed upper end 20 as described above.

The shower arm extension of this invention is particularly useful in older residences where the shower head was placed at a low elevation, and in recreational vans and modular or mobile homes where the ceilings are low. Nevertheless, it can be used in any situation where a higher elevation of the shower head is desired and where there is sufficient clearance to enable this invention to be used in the intended manner to achieve that higher elevation.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A shower arm extension adapted to be connected to a water pipe connection behind a vertical wall of a shower comprising a single, integral, rigid, attractive, elongated, cylindrical water pipe having a central portion and an upper end portion and a lower end portion, said upper end portion having a free end with external pipe threads onto which a threaded shower head is attachable, said lower end portion having a free end with external threads to be fitted into an internally threaded pipe coupling within a wall of a shower, said lower end portion being substantially straight and horizontally extending to a point generally midway of the entire horizontal distance between said free ends of said upper and lower end portions, said free end of said upper portion being substantially straight and having a longitudinal axis disposed downwardly from a horizontal plane from about 15° to about 45°, said central portion having a pair of generally equal and spaced bends and a substantially straight portion therebetween to define a substantially S-shaped central portion, said bends being connected respectively to said upper and lower end portions with all said portions being in a substantially vertical plane when said extension is installed in a shower, said shower arm extension configured such that where installed in a vertical shower wall said lower end portion extends horizontally outwardly through a passageway in a vertical shower wall, said extension being turned about a longitudinal axis of said lower end portion to cause said external threads to engage an internally threaded pipe coupling within a vertical wall of a shower without an upper one of said bends of said central portion of said upper end portion touching a vertical wall or a ceiling defining a shower, said upper end being located closely adjacent a wall defining a shower when said lower end portion is connected to an internally threaded pipe coupling, said extension extending horizontally outwardly from an internally threaded pipe coupling proceeding upwardly in said lower bend and said straight portion toward a wall of a shower in which an internally threaded coupling is located and proceeding upwardly in said upper bend to said upper straight portion extending outwardly and disposed downwardly from said horizontal plane.

2. The shower arm extension of claim 1 wherein said S-shaped portion includes a pair of bends each having generally the same radius from spaced centers, said direction of said upper end being generally tangential with respect to said radius of said spaced center of the upper one of said bends.

3. The shower arm extension of claim 1 wherein said S-shaped mid-portion includes a pair of bends each having generally the same radius from spaced centers, said downward direction being generally perpendicular to a line between said centers of said bends.

4. The shower arm extension of claim 1 wherein said S-shaped mid-portion includes an upper and a lower bend each having generally the same radius from spaced centers, said center of said lower bend being disposed closely to a vertical wall when said extension is connected to a water pipe and said center of said upper bend being disposed closely to a vertical plane passing through said end of said upper end portion.

* * * * *